US007775571B2

(12) United States Patent
Waisanen

(10) Patent No.: US 7,775,571 B2
(45) Date of Patent: Aug. 17, 2010

(54) BOTTOM BLOCK ASSEMBLY WITH PIVOTING TRUNNION PADDLES

(75) Inventor: Steven K. Waisanen, Big Bend, WI (US)

(73) Assignee: MHE Technologies, Inc., Wilmington, DE (US)

( * ) Notice: Subject to any disclaimer, the term of this patent is extended or adjusted under 35 U.S.C. 154(b) by 523 days.

(21) Appl. No.: 11/839,797

(22) Filed: Aug. 16, 2007

(65) Prior Publication Data

US 2008/0085177 A1 Apr. 10, 2008

Related U.S. Application Data

(60) Provisional application No. 60/838,281, filed on Aug. 17, 2006.

(51) Int. Cl.
*B66C 1/62* (2006.01)

(52) U.S. Cl. ..... 294/67.31; 294/86.41; 294/112

(58) Field of Classification Search ..... 294/81.51, 294/68.27, 67.31, 86.41, 82.15, 111, 112
See application file for complete search history.

(56) References Cited

U.S. PATENT DOCUMENTS 1,750,878 A * 3/1930 Coe ..... 294/81.51
2,340,915 A * 2/1944 Whittaker ..... 294/68.3
2,384,307 A * 9/1945 Husson et al. ..... 294/67.31
3,115,361 A * 12/1963 Miles ..... 294/112
3,527,495 A * 9/1970 Maradyn ..... 294/88
3,788,694 A * 1/1974 Hall ..... 294/67.31
4,108,485 A * 8/1978 Jennings ..... 294/81.51
5,163,804 A * 11/1992 Kobayashi ..... 414/739
6,062,620 A * 5/2000 Walker et al. ..... 294/67.31

* cited by examiner

*Primary Examiner*—Dean J Kramer
(74) *Attorney, Agent, or Firm*—Porter, Wright, Morris & Arthur, LLP

(57) ABSTRACT

A bottom block assembly for an overhead crane includes a main bottom block, an outer frame carried by the main bottom block and rotatable relative to the main bottom block about a vertical axis of rotation, and a pair of paddles carried by the outer frame and downwardly extending from the outer frame on opposed sides of the main bottom block. Upper ends of the paddles are pivotably secured to the outer frame about horizontal axes so that lower ends of the paddles pivot toward and away from each other. The paddles are pivotable between a closed position wherein each of the paddles is substantially vertical and an open position wherein the lower end of each of the paddles is outwardly pivoted away from a vertical central axis. Each of the paddles has a keyhole-shaped closed-section opening near its lower end.

16 Claims, 7 Drawing Sheets

BOTTOM BLOCK ASSEMBLY WITH PIVOTING TRUNNION PADDLES

CROSS-REFERENCE TO RELATED APPLICATIONS

This application claims the benefit of Provisional Patent Application No. 60/838,281 filed on Aug. 17, 2006, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to overhead cranes and, particularly, to bottom block assemblies of overhead cranes. More particularly, the present invention relates to bottom block assemblies that engage and disengage trunnions of a nuclear fuel bundle cask or the like.

BACKGROUND OF THE INVENTION

Conventional overhead cranes include a bottom block that, in combination with an upper block and a drum, raise and lower hooks or other lifting mechanisms attached to the bottom block. Such overhead cranes are often used in reactor facilities to transform or transport fuel bundles between a reactor building and a containment building. In some facilities, the components of the crane must pass through a 7 foot high by a 4 foot wide door into a containment room that is surrounded by 4 feet of concrete so that the crane can be installed therein. The crane is typically designed to be installed on two existing under hung I-beams that are about 16 feet off the floor of the containment room.

The overhead crane is used to engage trunnions of a cask and to lift and move the cask to a spent fuel pool. The crane then lowers the cask into the spent fuel pool, where the cask is filled with spent fuel rods. The crane is then used to raise the cask from the pool. The top of the cask should be clear of any obstructions to allow loading of the spent fuel rods into the cask. Therefore, the crane must be disengaged from the cask during the fuel loading process and reengaged once the fuel loading process is complete.

Generally, given the dimensions of the reactor facility, there is little clearance room between the trunnions of the cask and walls of the spent fuel pool. Bottom block assemblies of current cranes use C-shaped hooks to engage the cask trunnions. However, such hooks do not function properly because the thickness of the hooks is greater than available space between the cask trunnions and the spent fuel pool walls in all horizontal directions. Accordingly, there is a need in the art for an improved a bottom block assembly for use with an overhead crane.

SUMMARY OF THE INVENTION

The present invention provides a bottom block assembly for use with an overhead crane which addresses at least some of the above-noted problems of the related art. According to the present invention, a bottom block assembly for an overhead crane comprises a main bottom block and a pair of paddles downwardly extending on opposed sides of the main bottom block. Upper ends of the paddles are pivotable relative to the main bottom block about horizontal axes so that lower ends of the paddles pivot toward and away from each other. Each of the paddles has a closed-section opening near its lower end.

According to another aspect of the present invention, bottom block assembly for an overhead crane comprises a main bottom block, an outer frame carried by the main bottom block and rotatable relative to the main bottom block about a vertical axis of rotation, and a pair of paddles carried by the outer frame and downwardly extending from the outer frame on opposed sides of the main bottom block. Upper ends of the paddles are pivotable relative to the outer frame about horizontal axes so that lower ends of the paddles pivot toward and away from each other. Each of the paddles has a closed-section opening near its lower end.

According to yet another aspect of the present invention, a bottom block assembly for an overhead crane comprises a main bottom block, an outer frame carried by the main bottom block and rotatable relative to the main bottom block about a vertical axis of rotation, and a pair of paddles carried by the outer frame and downwardly extending from the outer frame on opposed sides of the main bottom block. Upper ends of the paddles are pivotably secured to the outer frame about horizontal axes so that lower ends of the paddles pivot toward and away from each other. The paddles are pivotable between a closed position wherein each of the paddles is substantially vertical and an open position wherein the lower end of each of the paddles is outwardly pivoted away from a vertical central axis. Each of the paddles has a keyhole-shaped closed-section opening near its lower end.

From the foregoing disclosure and the following more detailed description of various preferred embodiments it will be apparent to those skilled in the art that the present invention provides a significant advance in the technology of bottom block assemblies. Particularly, the invention provides a bottom block assembly which functions within narrow spaces between cask trunnions and spent fuel pool walls. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 3:
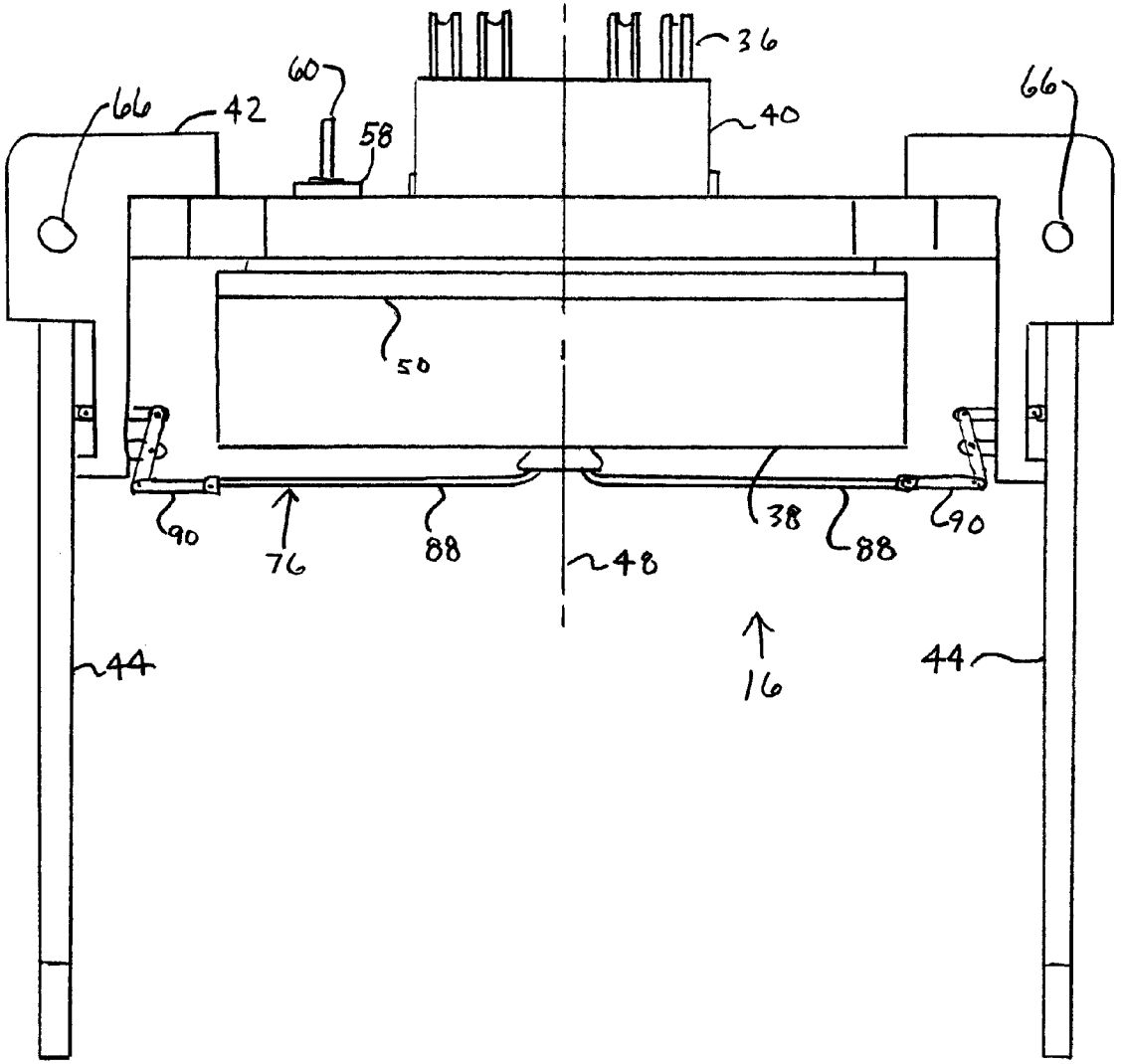
FIG. 3 is side elevation view of the bottom block assembly of FIGS. 1 and 2, wherein the paddles are in a closed position.

It should be understood that the appended drawings are not necessarily to scale, presenting a somewhat simplified representation of various preferred features illustrative of the basic principles of the invention. The specific design features of the bottom block assembly as disclosed herein, including, for example, specific dimensions, orientations, and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the bottom block assembly illustrated in the drawings. In general, up or upward refers to an upward direction generally within the plane of the paper in FIG. 3 and down or downward refers to a downward direction generally within the plane of the paper in FIG. 3. Also in general, fore or forward refers to a direction generally out of the plane of the paper in FIG. 3 and aft or rearward refers to a direction generally into the plane of the paper in FIG. 3.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved lower block assembly for an overhead crane disclosed herein. The following detailed discussion of various alternative and preferred embodiments will illustrate the general principles of the invention with reference to a bottom block assembly used to positively engage and disengage trunnions of a nuclear fuel bundle cask. Other embodiments suitable for other applications will be apparent to those skilled in the art given the benefit of this disclosure.

Figure 1:
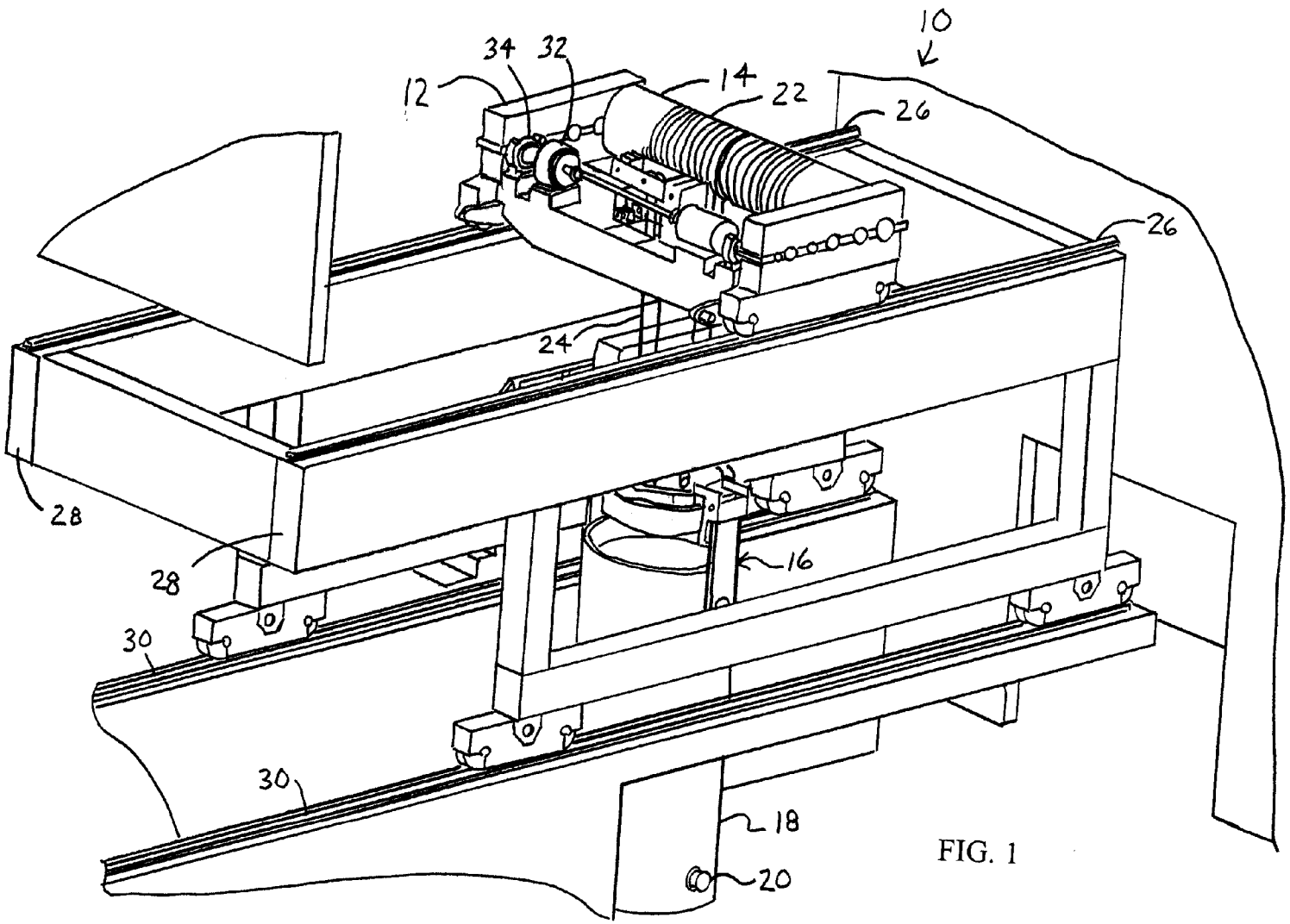
FIG. 1 is a perspective view of a an overhead crane including a bottom block assembly for transferring a fuel bundle cask between two buildings according a preferred embodiment of the present invention.
Figure 2:
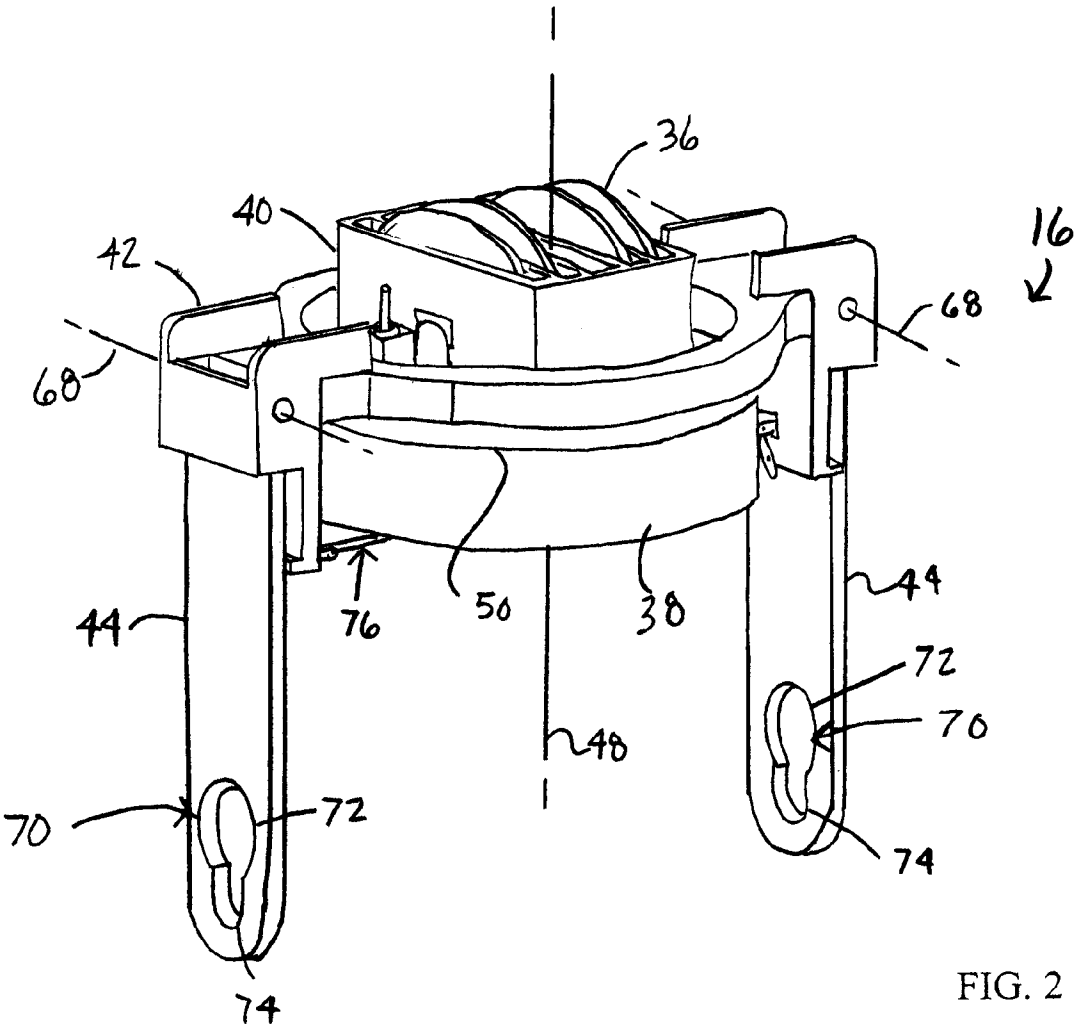
FIG. 2 is a perspective view of the bottom block assembly of FIG. 1, wherein a pair of paddles are in a closed position.
Figure 7:
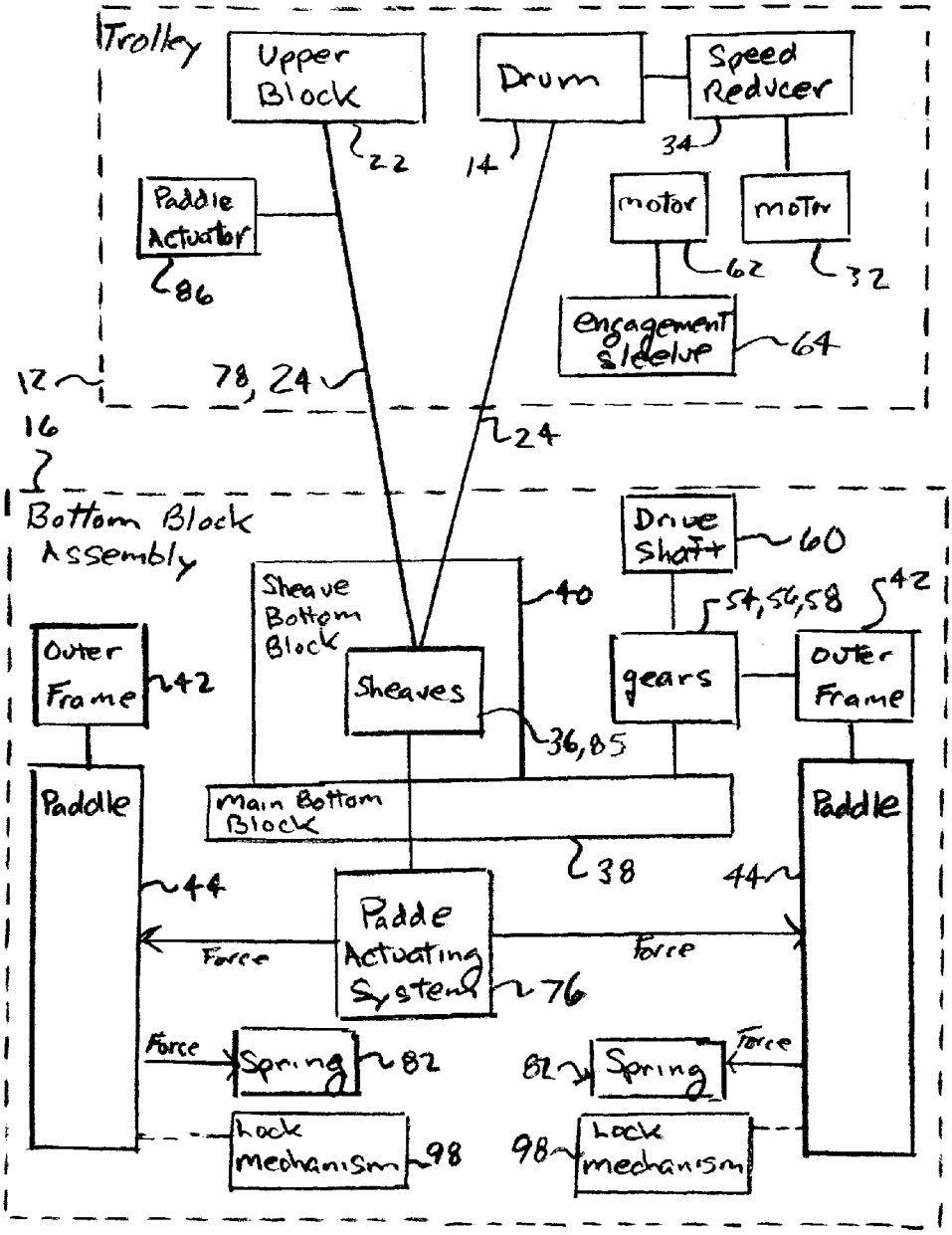
FIG. 7 is a block diagram showing the overhead crane of FIGS. 1 to 6.

FIGS. 1 and 7 illustrate an overhead crane 10 according to a preferred embodiment of the present invention. The crane 10 includes a trolley 12, a drum 14 carried by the trolley 12, a bottom block assembly 16 which engages a nuclear fuel bundle cask 18 having trunnions 20 to be transported, an upper block 22 carried by the trolley 12, and a plurality of wire ropes 24 which extend from the drum 14 to the bottom block assembly 16 and back to the upper block 22. The trolley 12 moves along a pair of spaced-apart rails 26 that sit atop girders 28. The girders 28 can translate along spaced-apart main support beams 30 which are parallel to and below the girders. The translation of the trolley 12 along the rails 26 and the translation of the rails 26 along the main support beams 30, allows the crane 10 to position the bottom block assembly 16 and the cask 18 engaged therewith virtually anywhere along the linear path along which the crane 10 is installed. As will be readily known to those of skill in the art, the crane 10 can alternatively have other configurations such as, for example, the rails 26 could be perpendicular to the main support beams 30 and/or the main support beams 30 could be curved to match inside wall contours of a round building or the like.

The drum 14 is rotatably mounted to the trolley 12 about a horizontal axis of rotation and is operably connected to a motor 32 by suitable speed reducers 34. The wire ropes 24 extend from the drum 14 to the bottom block assembly 16 which includes a plurality of sheaves 36 around which the wire ropes 24 pass. From the bottom block assembly 16, the wire ropes 24 extend to the upper block 22. After reeving back and forth between the bottom block assembly 16 and the upper block 22, as will be readily understood by those of ordinary skill in the art, the wire ropes 24 end at the upper block 22. As the drum 14 is rotating in one direction to wind up the wire ropes 24, the bottom block assembly 16 is lifted. As the drum 14 is rotating in the other direction to unwind the wire ropes 24, the bottom block assembly 16 is lowered.

As best shown in FIGS. 2 to 7, the illustrated a bottom block assembly 16 includes a main bottom block or frame 38, a sheave bottom block 40 carried by the main bottom block 38, an outer table or frame 42 carried by the main bottom block 38 and rotatable relative to the main bottom block 38, and a pair of trunnion paddles 44 carried by the outer frame 42 and pivotable relative to the outer frame 42 to engage and disengage the cask trunnions 20. The sheaves 36 are rotatably secured to the sheave bottom block 40 by a pin 46 forming a common horizontally extending axis of rotation intersecting a vertically extending central axis 48 of the bottom block assembly 16.

The outer frame 42 is rotatably secured to the main bottom block 38 by a slew bearing 50 so that the outer frame 42 is rotatable about the vertical central axis 48 of the bottom block assembly 16. Rotation of the outer frame 42 enables the trunnion paddles 44 to be positioned proximate the cask trunnions 20. An illustrated drive system 52 for rotating the outer frame 42 includes an internal-toothed ring gear 54 secured to the outer frame 42, a pinion gear 56 rotatably secured to the top of the main bottom block 38 and operably engaging the ring gear 54, and a water-proof worm speed reducer 58 mounted to the top of the main bottom block 38 and driving the pinion gear 56. The speed reducer 58 includes a vertically extending input or drive shaft 60. It is noted that only the ring gear 54 and the pinion gear 56 are exposed and each are preferably formed of a non-corroding material. A motor 62 and spring-loaded engagement sleeve 64 are mounted to and carried by the trolley 12, and as such are never lowered into the spent fuel pond. It is noted that all electrical components of the drive system 52 are located at the trolley 12 and thus are not submerged into the pool. Rotation of the outer frame 42 only occurs when the bottom block assembly 16 is in a full up position where the drive shaft 60 engages the engagement sleeve 64 to engage the motor 62 and the motor 62 is activated. When the bottom block assembly 16 is lowered and the drive shaft 60 is disengaged from the motor 62, the speed reducer 58 will not rotate due to its self-locking feature, thus locking the outer frame 42 against rotation relative to the main bottom block 38. Preferably, rotation only occurs when the bottom block assembly 16 is in its full up position.

The paddles 44 are pivotably attached by pins 66 to the outer frame 42 on opposed sides of the outer frame 42 and extend downwardly from the outer frame 42. The paddles 44 are pivotable about parallel and spaced-apart horizontal pivot axes 68 which are each perpendicular and spaced-apart from the vertical central axis 48. The paddles 44 are each pivotable between a closed or in position wherein the paddle 44 is substantially vertical (best shown in FIG. 3) and an open or out position wherein the lower end of the paddle 44 is outwardly pivoted away from the vertical central axis (best shown in FIG. 4).

The lower end of each paddle 44 has a closed-section opening or slot 70 for engaging the trunnion 20 of the fuel bundle cask 18. the term "closed section" is used in this specification and the claims to mean that the slot does not extend to an edge of the paddles so that the paddle completely encircles the slot. The illustrated slot 70 is key-hole shaped having a larger portion 72 and a smaller portion 74 located below the larger portion. The illustrated slot 70 has smaller and larger portions 72, 74 that are each circular with a connecting portion having parallel side walls extending between the larger and smaller portions 72, 74. The larger portion 72 is sized for passage of a large or flange portion of the trunnions 20 therethrough while the smaller portion 74 is sized so that the same will not pass therethrough. It is noted that the slot can alternatively have any other suitable shape depending on the shape of the trunnions 20. The closed-section slot 70 allows for a thinner "hook" which can clear the space between the cask trunnion 20 and the spent fuel pool wall. In use, the paddles 44 are rotated (by rotation of the outer frame 42 about the central axis 48) and pivoted (by pivoting about their pivot axes 68) into position relative to the cask trunnion 20 to engage the cask 18, and then the bottom block assembly 16 is lifted by the crane 10 to transport the cask 18.

The illustrated paddles 44 are thin enough such that there is sufficient clearance between the cask 18 and the side walls of the spent fuel pool for the paddles 44 to engage or disengage the cask 18. The paddles 44 including the key-hole shaped slot 70 allow a larger outside diameter of the cask trunnion 20 to pass through the larger portion of the slot 70 when the paddles are in the open position. Once the trunnion paddles 44 are moved to the closed position, the cask 18 is captivated by the bottom block assembly 16 and the cask trunnions 20 are engaged by the smaller portion of the slot 70.

The paddles are pivoted between their closed and open positions using a paddle actuator system 76. The illustrated paddle actuator system 76 is a rope/pulley system or rope/lever system (best shown in FIG. 4). The illustrated actuator system 76 operates by tensioning a wire rope 78 that passes through an inner bottom block 80 positioned in the center of the larger sheave bottom block 40. The illustrated actuator system 76 includes springs 82 which bias the paddles 44 to the closed position where they engage a mechanical stop 84 formed by the outer frame 42. Tensioning the wire rope 78 pivots the paddles 44 against the bias of the springs 82 to the open position. Untensioning the wire rope 78 permits the springs 82 to resiliently return the paddles 44 to the closed position.

Figure 4:
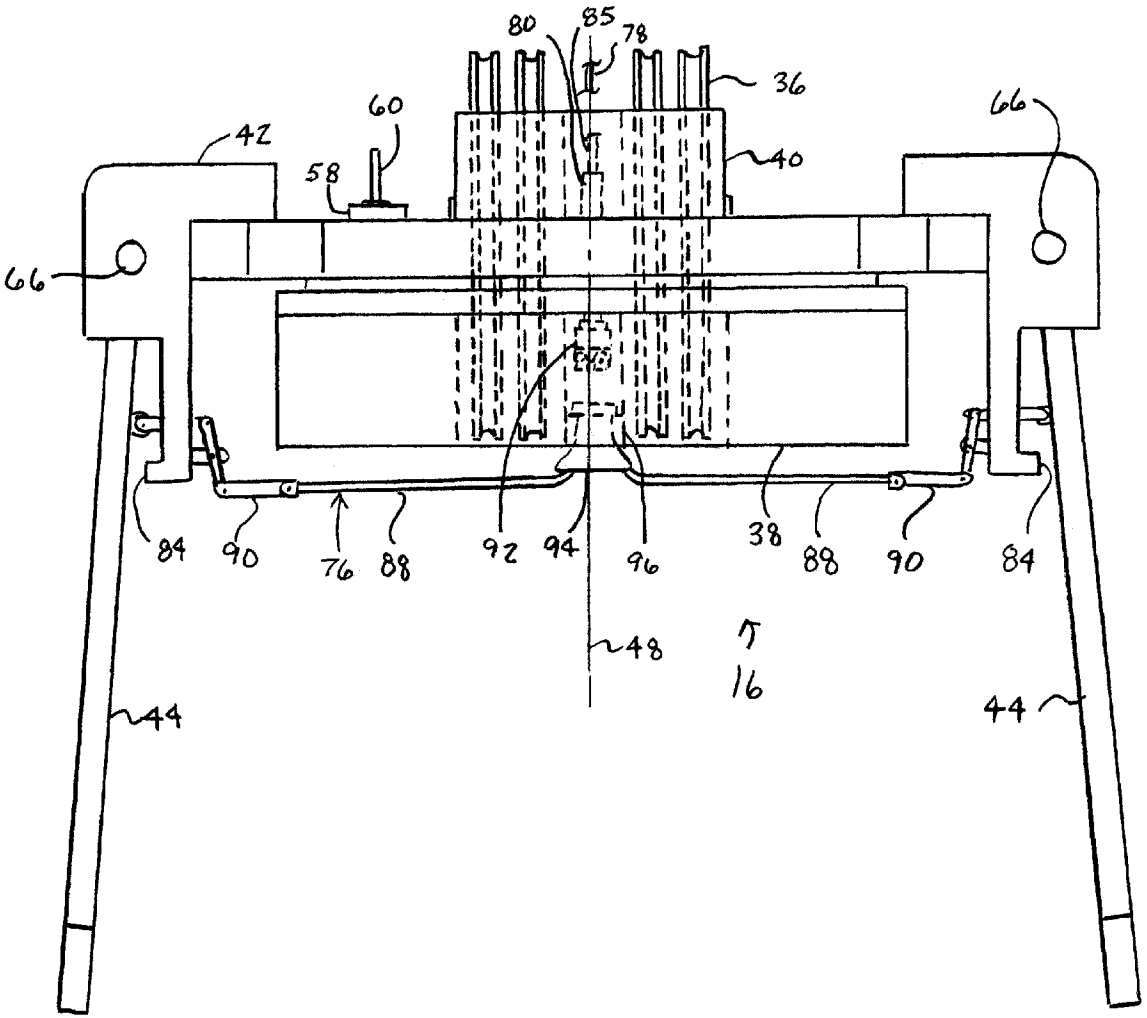
FIG. 4 is side elevation view of the bottom block assembly of FIGS. 1 to 3, but wherein the paddles are in an open position.
Figure 5:
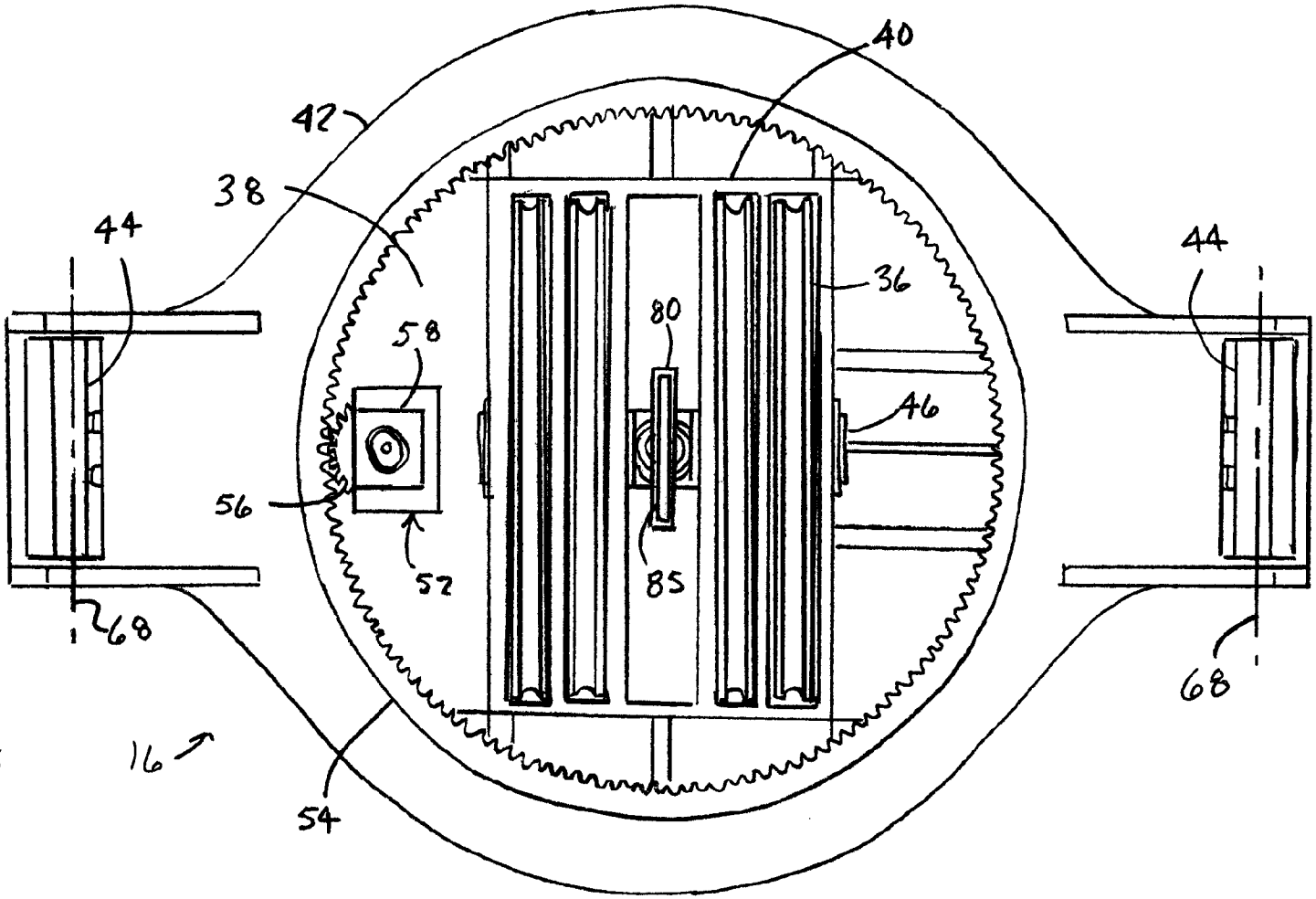
FIG. 5 is top plan view of the bottom block assembly of FIGS. 1 to 4 showing a bottom block frame and a rotatable outer frame.
Figure 6:
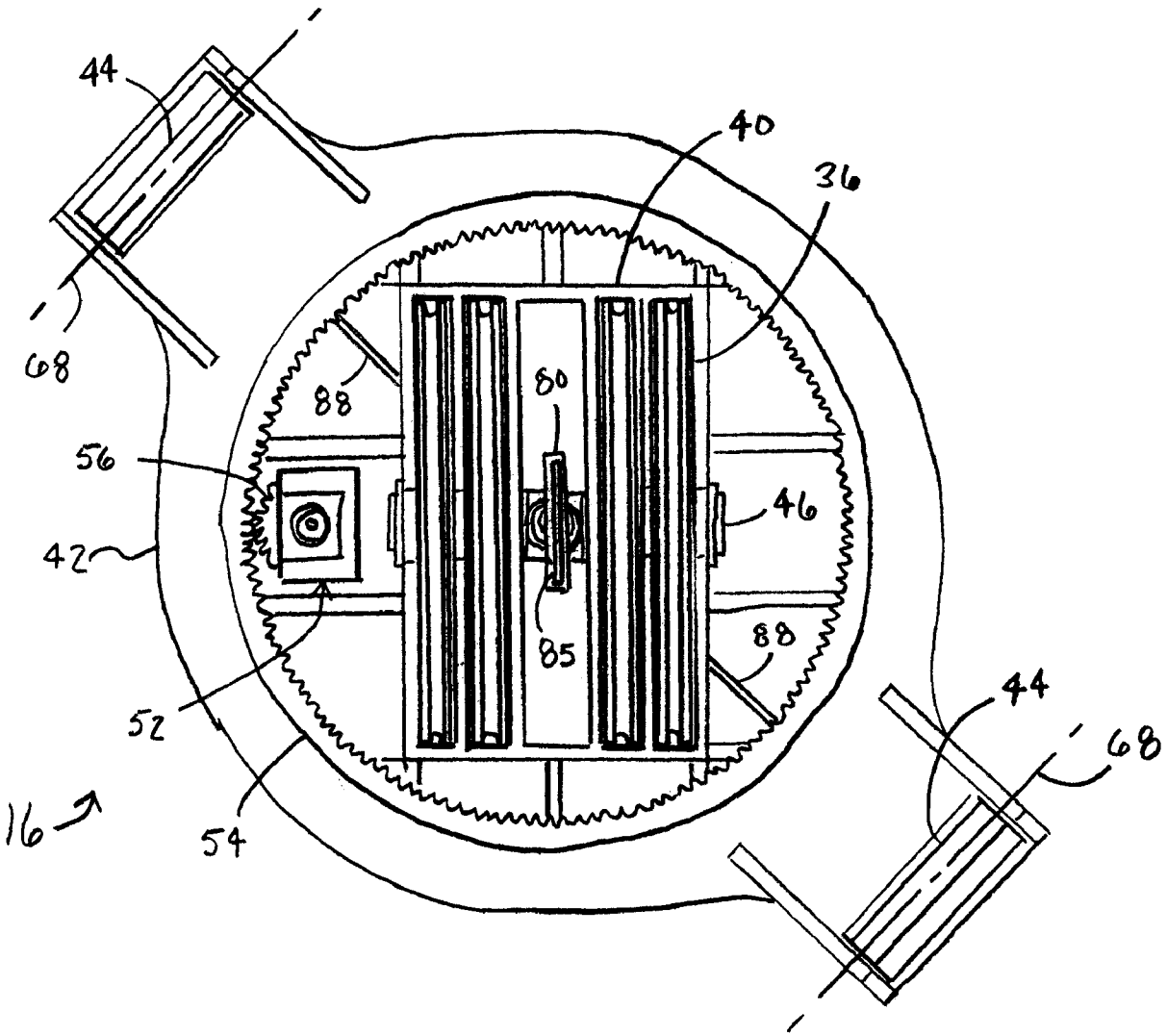
FIG. 6 is top plan view of the bottom block assembly similar to FIG. 5 but showing the outer frame rotated about 45 degrees relative to the bottom block frame.

The paddles 44 are pivoted between the open position and the closed position using the inner bottom block 80. By raising and lowering the inner bottom block 80, the paddles 44 are forced open (when the inner bottom block 80 is raised) and biased closed by the springs 82 (when the inner bottom block 80 is lowered). As best shown in FIGS. 1 and 4, one end of the wire rope 78 passes through an independent traveling sheave 85 in the inner bottom block 80 and comes off the same drum 14 as the main bottom block reeving to thereby maintain the same position as the main bottom block 38 such that accidental actuation of the paddles 44 cannot occur. The wire rope 78 passes through the inner bottom block 80 and is dead ended on the floating upper block 22 on the trolley 12. An actuator 86 is attached to the dead end of the wire rope 78 to tension and untension the wire rope 78 allowing the wire rope 78 to raise and lower the inner bottom block upon activation of the actuator 86.

Tensioning the dead end rope 78 raises the inner bottom block 80 with respect to the main bottom block 38, thereby putting tension on paddle ropes 88 that extend from the inner bottom block 80 to actuation levers 90 secured to the outer frame 42. The paddle ropes 88 are suitably connected to the inner bottom bock 80 with a bearing 92 so that the paddle ropes 88 rotate with the outer frame 42, when the outer frame is rotated, while the inner bottom block 80 remains stationary with the main bottom block 38. The paddle ropes 88 pass through a deflector or guide 94 on both sides of the main bottom block 38. The illustrated deflector 94 sits on a bearing 96 so that the deflector 94 rotates with the outer frame 42 when the outer frame is rotated relative to the main bottom block 38. The levers 90 are adapted so that when tension is applied to the paddle ropes 88 by upward movement of the inner bottom block 80, the paddles 44 rotate away from the main bottom block 38 to the open position thereby putting tension on the springs 82 used to hold the paddles 44 in the closed position. When the dead end rope 78 is untensioned so that the inner bottom block 80 is lowered, tension in the paddle ropes 88 is released thereby allowing the springs 82 to force the paddles 44 to the closed position.

The bottom block assembly 16 can include a lock mechanism 98 to secure the paddles 44 in the closed position. The lock mechanism 98 is not released until the bottom block rope 78 is raised to actuate the paddle actuator system 76.

The illustrated paddles 44 are manufactured from high strength steel plates and are specifically designed to clear the cask trunnions 20 when lowering the bottom block assembly 16 to engage the cask 18. A cask transport operation utilizing the overhead crane 10 will now be described. With the cask 18 sitting on the floor, the trolley 12 is moved until the bottom block assembly 16 is positioned over the cask 18. If needed, the outer frame 42 is rotated relative to the main bottom block 38 to align the paddles 44 with the cask trunnions 20. If needed, the rope 78 is raised to tension the rope 78 and actuate the paddle actuator system 76 to pivot the paddles 44 to the open position. The bottom block assembly 16 is then lowered so that the paddles 44 go over the cask trunnions 20. The trunnions 20 extend through the larger portion 72 of the slots 70 as the paddles 44 go down over the cask trunnions 20. The rope 78 is then lowered to untension the rope 78 and actuate the paddle actuator system 76 to permit the springs 82 to pivot the paddles 44 to the closed position where they engage the mechanical stops 84. The bottom block assembly 16 is then raised so that the cask trunnions 20 go into the smaller portion 74 of the slots 70 to secure the cask 18 to the lower block assembly 16. The bottom block assembly 16 along with the cask 18 is then raised and the trolley 12 moves the lower block assembly 16 and the cask 18 to the spent fuel pool. If needed, the outer frame 42 is rotated relative to the main bottom block 38 to align the cask 18 with a loading stand in the spent fuel pool. The bottom block assembly 16 and the cask 18 are then lowered into the pool. Once in the bottom block assembly has been disengaged and raised from the cask (using a procedure opposite of that described above), fuel bundles are loaded into the cask 18, the top of the cask 18 is plugged, and the cask 18 is evacuated. The bottom block assembly 16 is then lowered and secured to the cask 18 using the same procedure as described above and the bottom block assembly 16 and the cask 18 is raised out of the pool. The trolley 12 moves the bottom block assembly 16 and the cask 18 over a transfer car and the cask is loaded onto the transfer car.

It is apparent from the foregoing disclosure that bottom block assembly 16 according to the present invention function properly within the narrow available space between the cask trunnions 20 and the spent fuel pool walls.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A bottom block assembly for an overhead crane, said bottom block assembly comprising, in combination:

a main bottom block;

a pair of paddles downwardly extending on opposed sides of the main bottom block;

wherein upper ends of the paddles are pivotable relative to the main bottom block about horizontal axes so that lower ends of the paddles pivot toward and away from each other;

wherein each of the paddles has a closed-section opening near its lower end;

an outer frame carried by the main bottom block and rotatable relative to the main bottom block about a vertical axis of rotation;

a drive system for selectively rotating the outer frame relative to the main bottom block; and wherein the drive system is engaged and disengaged depending on a vertical position of the main bottom block.

2. The bottom block assembly according to claim 1, wherein the closed-section opening is key-hole shaped.

3. The bottom block assembly according to claim 1, wherein the pair of paddles are carried by the outer frame and downwardly extending from the outer frame.

4. The bottom block assembly according to claim 1, further comprising an actuator system for selectively pivoting the paddles including ropes and levers.

5. The bottom block assembly according to claim 1, wherein the paddles are pivotable between a closed position wherein each of the paddles is substantially vertical and an open position wherein the lower end of each of the paddles is outwardly pivoted away from a vertical central axis.

6. The bottom block assembly according to claim 5, wherein springs bias the paddles to the closed position.

7. A bottom block assembly for an overhead crane, said bottom block assembly comprising, in combination:

a main bottom block;

an outer frame carried by the main bottom block and rotatable relative to the main bottom block about a vertical axis of rotation;

a pair of paddles carried by the outer frame and downwardly extending from the outer frame on opposed sides of the main bottom block;

wherein upper ends of the paddles are pivotable relative to the outer frame about horizontal axes so that lower ends of the paddles pivot toward and away from each other; and wherein each of the paddles has a closed-section opening near its lower end;

wherein the paddles are pivotable between a closed position wherein each of the paddles is substantially vertical and an open position wherein the lower end of each of the paddles is outwardly pivoted away from a vertical central axis; and wherein springs bias the paddles to the closed position.

8. The bottom block assembly according to claim 7, wherein the closed-section opening is key-hole shaped.

9. The bottom block assembly according to claim 7, further comprising a drive system for selectively rotating the outer frame relative to the main bottom block.

10. The bottom block assembly according to claim 9, wherein the drive system is engaged and disengaged depending on a vertical position of the main bottom block.

11. The bottom block assembly according to claim 7, further comprising an actuator system for selectively pivoting the paddles including ropes and levers.

12. A bottom block assembly for an overhead crane, said bottom block assembly comprising, in combination:

a main bottom block;

an outer frame carried by the main bottom block and rotatable relative to the main bottom block about a vertical axis of rotation;

a pair of paddles carried by the outer frame and downwardly extending from the outer frame on opposed sides of the main bottom block;

wherein upper ends of the paddles are pivotable relative to the outer frame about horizontal axes so that lower ends of the paddles pivot toward and away from each other;

wherein each of the paddles has a closed-section opening near its lower end;

a drive system for selectively rotating the outer frame relative to the main bottom block; and wherein the drive system is engaged and disengaged depending on a vertical position of the main bottom block.

13. A bottom block assembly for an overhead crane, said bottom block assembly comprising, in combination:

a main bottom block;

an outer frame carried by the main bottom block and rotatable relative to the main bottom block about a vertical axis of rotation;

a pair of paddles carried by the outer frame and downwardly extending from the outer frame on opposed sides of the main bottom block;

wherein upper ends of the paddles are pivotably secured to the outer frame about horizontal axes so that lower ends of the paddles pivot toward and away from each other;

wherein the paddles are pivotable between a closed position wherein each of the paddles is substantially vertical and an open position wherein the lower end of each of the paddles is outwardly pivoted away from a vertical central axis; and wherein each of the paddles has a keyhole-shaped closed-section opening near its lower end; and an actuator system for selectively pivoting the paddles including ropes and levers.

14. The bottom block assembly according to claim 13, further comprising a drive system for selectively rotating the outer frame relative to the main bottom block.

15. The bottom block assembly according to claim 13, wherein the drive system is engaged and disengaged depending on a vertical position of the main bottom block.

16. A bottom block assembly for an overhead crane, said bottom block assembly comprising, in combination:

a main bottom block;

an outer frame carried by the main bottom block and rotatable relative to the main bottom block about a vertical axis of rotation;

a pair of paddles carried by the outer frame and downwardly extending from the outer frame on opposed sides of the main bottom block;

wherein upper ends of the paddles are pivotably secured to the outer frame about horizontal axes so that lower ends of the paddles pivot toward and away from each other;

wherein the paddles are pivotable between a closed position wherein each of the paddles is substantially vertical and an open position wherein the lower end of each of the paddles is outwardly pivoted away from a vertical central axis;

wherein each of the paddles has a keyhole-shaped closed-section opening near its lower end; and wherein springs bias the paddles to the closed position.

* * * * *